US005494452A

United States Patent [19]

Matsumoto et al.

[11] Patent Number: 5,494,452

[45] Date of Patent: Feb. 27, 1996

[54] LOCKING MECHANISM FOR CONNECTOR

[75] Inventors: Mitsuhiro Matsumoto; Takeyuki Hamaguchi, both of Shizuoka, Japan

[73] Assignee: Yazaki Corporation, Tokyo, Japan

[21] Appl. No.: 214,493

[22] Filed: Mar. 18, 1994

[30] Foreign Application Priority Data

Mar. 19, 1993 [JP] Japan ..... 5-012461 U

[51] Int. Cl.[6] ..... H01R 13/627

[52] U.S. Cl. ..... 439/358; 439/629

[58] Field of Search ..... 439/350, 351, 439/352, 353, 354, 357, 358, 682, 629–632

[56] References Cited

U.S. PATENT DOCUMENTS 4,032,209 6/1977 Rutkowski ..... 439/358
4,579,411 4/1986 Cobaugh et al. ..... 439/357
5,197,901 3/1993 Hashiguchi ..... 439/357
5,334,041 8/1994 Anbo et al. ..... 439/357

FOREIGN PATENT DOCUMENTS 62-4079 12/1987 Japan .

*Primary Examiner*—Gary F. Paumen
*Assistant Examiner*—Hien D. Vu
*Attorney, Agent, or Firm*—Wigman, Cohen, Leitner & Myers

[57] ABSTRACT

A locking mechanism for a connector has a first connector housing formed with a fitting hood and a second connector housing mated with the first connector housing and formed with a lock projection. A leaf spring member fitted to the first connector housing is formed with a lock hole engageable with the lock projection and a push spring piece brought into contact with an inner surface of the fitting hood so as to urge the lock hole against the lock projection.

8 Claims, 3 Drawing Sheets

LOCKING MECHANISM FOR CONNECTOR

BACKGROUND OF THE INVENTION

The present invention relates to a locking mechanism for a connector, and more specifically to a connector's locking mechanism by which a pair of male and female connectors can be mated with each other by an instantaneous engagement (referred to as inertia lock).

A conventional locking mechanism for a connector is disclosed in Japanese Published Unexamined (Kokai) Utility Model Application No. 62-4079, for instance.

In this conventional locking mechanism, a resin male connector housing is formed with a hood portion at an outer wall thereof. A resin female connector housing is formed with an engage projection. Both the male and female connector housings are mated with each other by interposing a locking leaf spring member. The locking leaf spring member is formed with a base portion and an engage hole portion. The base portion of the leaf spring member is fitted to the hood portion of the male connector housing. Further, the engage hole portion of the leaf spring portion is engaged with the engage projection of the female connector housing when both the connector housings are mated with each other.

When the female connector housing is mated with the male connector housing, the end of the locking leaf spring member is deformed outward, so that the engage projection of the female connector housing can be engaged with the engage hole of the locking leaf spring member. Further, both the male and female connector housings are provided with terminal portions connected to each other whenever both the connector housings are mated with each other.

In the above-mentioned conventional locking mechanism for a connector, since the locking leaf spring member is deformed simply outward whenever the male and female connector housings are mated with each other, in the case where both the connector housings are mated with each other instantaneously by an impact force (inertia lock), there exists a problem in that both the connector housings cannot be mated perfectly due to the influence of the sliding resistance between both the terminal portions of the two connector housings.

SUMMARY OF THE INVENTION

With these problems in mind, therefore, it is the primary object of the present Invention to provide a locking mechanism for a connector by which a perfect instantaneous mating of two male and female connector housings is enabled by an interia lock, without causing an imperfect engagement.

To achieve the above-mentioned object, the present invention provides a locking mechanism for a connector, comprising: a first connector housing formed with a fitting hood; a second connector housing mated with said first connector housing and formed with a lock projection; and a leaf spring member fitted to said first connector housing and formed with a lock hole engaged with the lock projection and a push spring piece brought into contact with an inner surface of the fitting hood so as to urge the lock hole against the lock projection.

In mating of the connector housings, the lock projection of the second connector housing is brought into contact with the end portion of the leaf spring member fitted to the fitting hood of the first connector housing, so that the leaf spring member is deformed outward. In this case, since the push spring piece of the leaf spring member is brought into contact with the extension portion of the fitting hood, the further deformation of the leaf spring member is elastically restricted. Therefore, when the two connector housings are mated, since a relatively large mating force is required for the worker to additionally deform the push spring piece of the leaf spring member, the two connector housings can be mated instantaneously due to inertia lock, thus preventing an imperfect mating of the two connector housings.

DETAILED DESCRIPTION OF THE PREFERRED EMBODIMENTS

Figure 1:
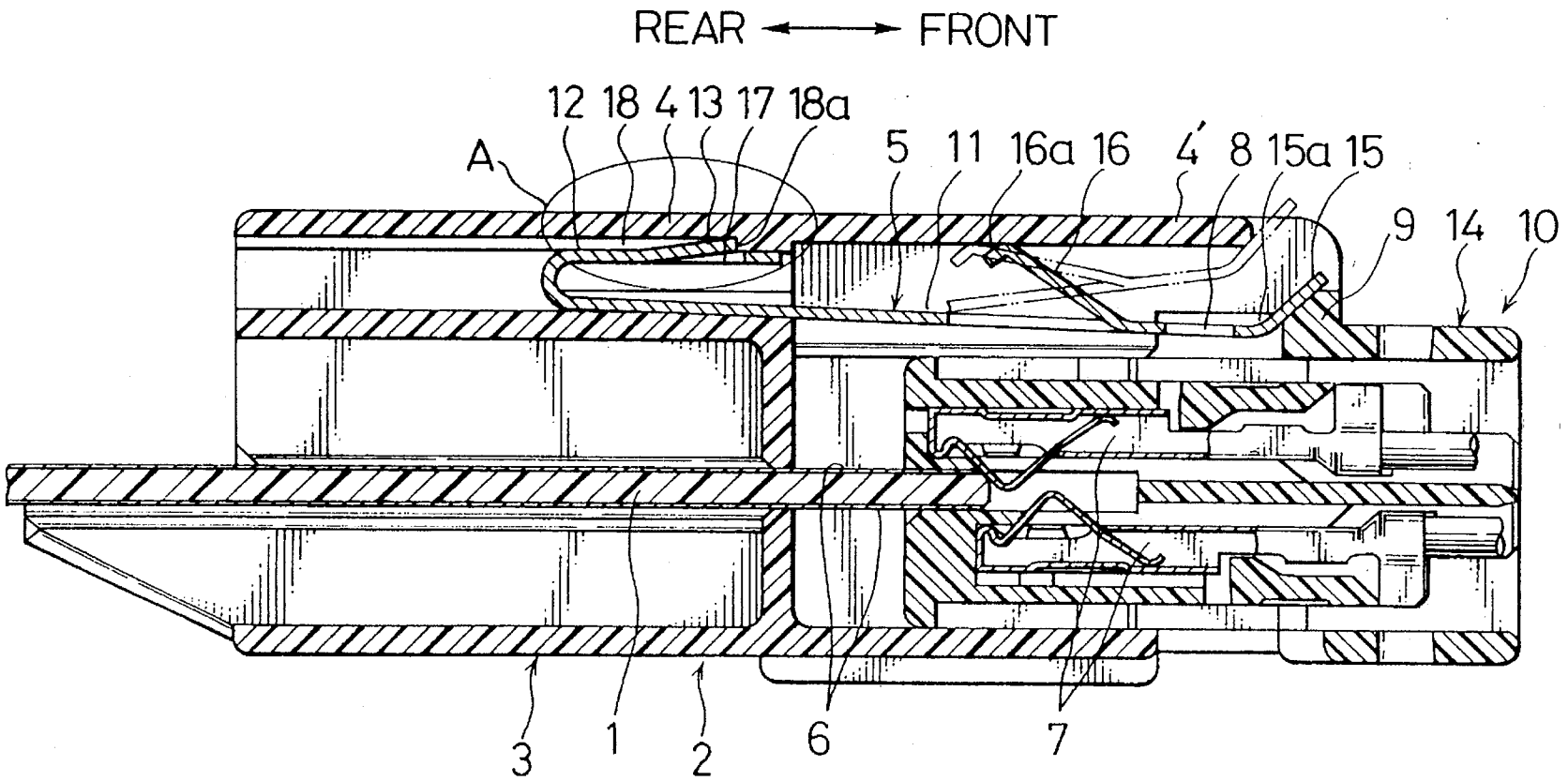
FIG. 1 is a longitudinal cross-sectional view showing an embodiment of the locking mechanism for a connector according to the present invention.

FIG. 1 shows a locking mechanism of the connector according to the present invention.

In FIG. 1, the connector can be roughly composed of a resin female connector 2, a resin male connector 10, and a metal leaf spring member 5. A card-edge type female connector housing 3 is mated and simultaneously locked with a male connector housing 14 by using the leaf spring member 5 interposed between both the connector housings 3, 14. The female connector housing 3 accommodates a printed circuit board 1, and is formed with a fitting hood portion 4. The male connector housing 14 is provided with two contact terminals 7 brought into contact with two terminal end portions 6 of the printed circuit board 1 (when mated) and formed with a lock projection 9. The leaf spring member 5 is inserted into the fitting hood portion 4 of the female connector housing 3 and further engaged with the lock projection 9 of the male connector housing 14.

Figure 2:
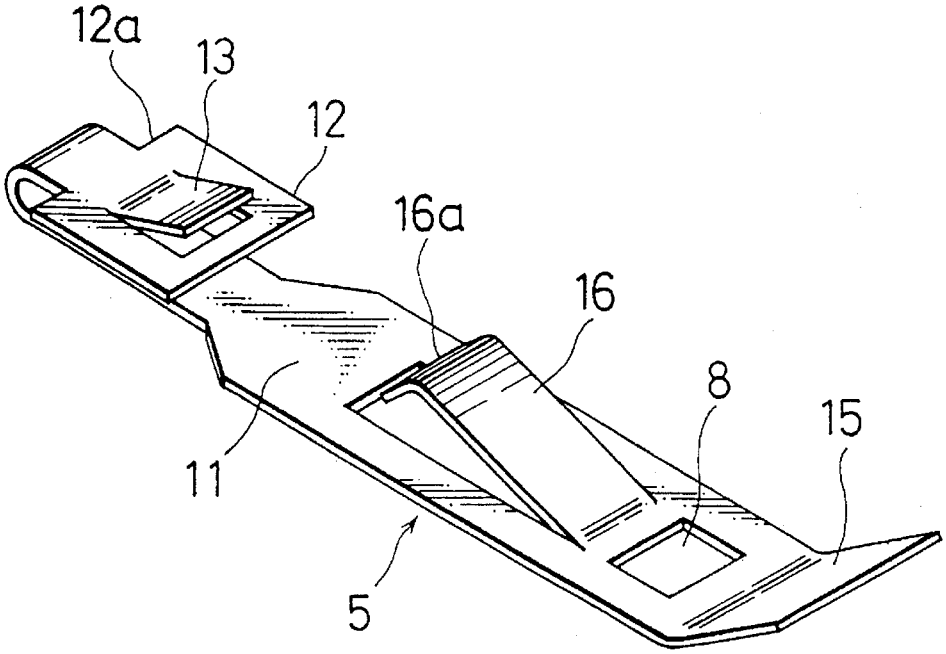
FIG. 2 is a perspective view showing a leaf spring member of the locking mechanism shown in FIG. 1.

In more detail with reference to FIG. 2, the leaf spring member 5 is formed with a return portion 12 at a rear (left side in FIG. 1) end of a base plate portion 11, a push spring piece portion 16 at a middle portion thereof, and a contact slope portion 15 at a front (right side in FIG. 1) end portion thereof.

Figure 3:
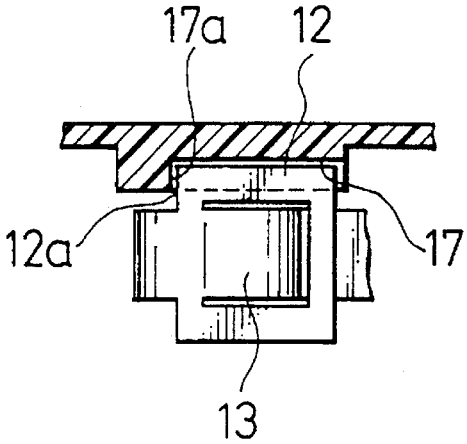
FIG. 3 is a partial transverse cross-sectional view showing a portion designated by A in FIG. 1.

The return portion 12 is bent into a roughly U-shape from the rear end to the front side of the base portion 11, and formed with an engage projection 13 cut away from the return portion 12 so as to extend outward as a first support portion engaged with the fitting hood portion 4 of the female connector housing 3. Further, as shown in FIG. 3, the return portion 12 has a rear end surface **12*a*. Therefore, when the leaf spring member 5 is inserted into the fitting hood portion 4 of the female connector housing 3 from the rear (left) side in FIG. 1 along a guide groove 17 formed within the fitting hood portion 4, the rear end surface 12*a* is brought into contact with two rear stepped portions 17*a* (see FIG. 3) of the guide groove 17. In addition, the engage projection 13 is engaged with a front stepped portion 18*a* (see FIG. 1) of an engage groove 18 formed on the outer portion of the guide groove 17**.

The push spring piece portion 16 is also bent obliquely outward so as to extend toward the rear end of the base plate portion 11 as a second support portion brought into contact with the fitting hood portion 4 of the female connector housing 3. Therefore, in more derail, when the leaf spring member 5 is inserted into the fitting hood portion 4 of the female connector housing 3, a bent end portion 16*a* of the push spring piece 16 is brought into contact with the inner wall surface of an frontward extension portion 4' (see FIG. 1) of the fitting hood portion 4 of the female connector housing 3 so as to be urged in the inward direction.

The contact slope portion 15 is also bent obliquely outward so as to extend from the front end of the base plate portion 11 and further to be brought into contact with the lock projection 9 of the male connector housing 14 (when two connector housings are being mated). Further, the leaf spring member 5 is formed with a lock hole 8 in the base portion 11, as shown in FIG. 2. Therefore, when the male connector housing 14 is mated with the female connector housing 3, the lock projection 9 of the male connector housing 14 is first brought into contact with the contact slope portion 15 and then engaged with the lock hole 8 of the leaf spring member 5.

In assembly, first the leaf spring member 5 is inserted into the fitting hood portion 4 of the female connector housing 3. Here, since the front end of the extending portion 4' of the hood portion 4 roughly reaches a bent portion 15*a* of the contact slope portion 15 of the leaf spring member 5, it is possible to deform the front end portion of the contact slope portion 15 of the leaf spring member 5 upward and outward, as shown by dot-dot-dashed lines in FIG. 1. In other words, when the contact slope portion 15 is deformed upward by the user's finger, it is possible to release the leaf spring member 5 directly from the lock projection 9 of the male connector housing 14. In addition, in this embodiment, there exists another advantage that the fitting hood portion 4 can be formed thin to that extent.

Figure 4:
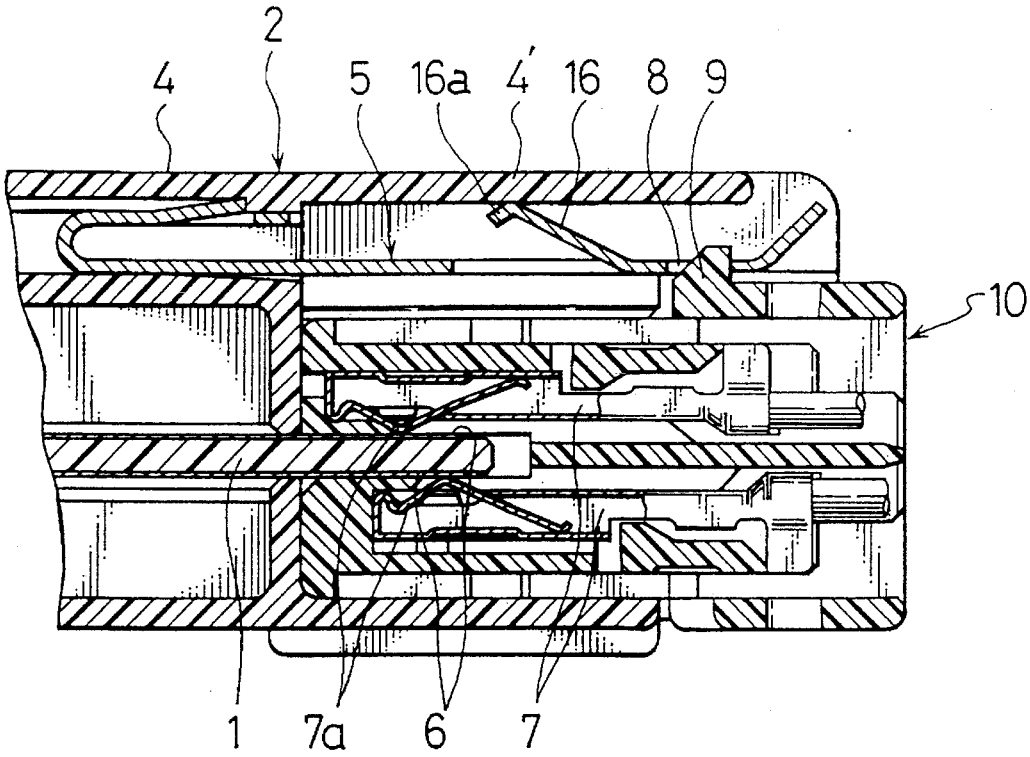
FIG. 4 is a longitudinal cross-sectional view of the same connector shown in FIG. 1, for assistance in explaining the mating status of both the connector housings.

Further, when the male connector housing 14 is mated with the female connector housing 3 as shown in FIG. 4, the lock projection 9 of the male connector housing 14 is engaged with the lock hole 8 of the leaf spring member 5. In this operation, when the lock projection 9 of the male connector housing 14 is in contact with the contact slope portion 15 of the leaf spring member 5, since the leaf spring member 5 is deformed upward, the upward projecting push spring piece 16 is also deformed, so that a relatively large initial engaging force is required to mate both the two connector housings 14 and 3. Accordingly, it is possible to mate both connector housings momentarily, and thereby the terminal portions 6 of the printed circuit board 1 can be securely connected to the two contact terminals 7 of the male connector housing 14.

Further, as shown in FIG. 1 and 4, the two contact terminals 7 of the male connector 10 are arranged in symmetrical positional relationship on both sides of the printed circuit board 1 of the female connector 2 so as to sandwich the printed circuit board 1 and further to be offset in the connector mating direction. Therefore, it is possible to reduce the sliding resistance between the contact terminals 7 and the printed circuit board 1, that is, the mating force between the female and male connectors 2 and 10.

As described above, in the locking mechanism for a connector according to the present invention, when the connector housings are mated, since the push spring piece 16 is brought into contact with the inner surface of the extension portion 4' of the fitting hood portion 4 of the female connector housing 3, since a relatively large initial mating force is required, it is possible to absorb an initial shock generated when the two connector housings are mated by an inertia lock, with the result that a secure engagement between the two terminal portions can be attained, while preventing an imperfect connector mating.

Although one preferred embodiment of the present invention has been specifically described herein, it will be apparent to those skilled in the art to which the invention pertains that variations and modifications of that embodiment shown and described herein may be made without departing from the spirit and scope of the invention. Accordingly, it is intended that the invention be limited only to the extent required by the appended claims and the applicable rules of law.

What is claimed is:

1. A locking mechanism for an electrical connector, comprising:

a first electrical connector housing formed with a fitting hood;

a second electrical connector housing mated with said first electrical connector housing and formed with a lock projection; and a leaf spring member fitted to said first electrical connector housing and formed with a lock hole for engaging with the lock projection and a cantilevered push spring piece brought into contact with an inner surface of the fitting hood so as to urge the lock hole against the lock projection, said push spring piece slidably engaging along an intermediate extent of an inner surface of the fitting hood when the second electrical connector housing is mated with the first electrical connector housing.

2. The locking mechanism for a connector of claim 1, wherein said leaf spring member is formed with a base portion extending in a mating direction between said first and second connector housings; a return portion formed at one end of the base portion and supported by said first connector housing; and a contact slope portion formed at the other end of the base portion for allowing the lock hole to be engaged with the lock projection, when being brought into contact with the lock projection and thereby the base portion is deformed against an elastic force of the base portion and the push spring piece.

3. The locking mechanism for the electrical connector of claim 2, wherein the return portion has a U-shape for securing the return portion to said first connector housing; wherein the contact slope portion extends obliquely outward away from the fitting hood of said first connector housing when the base portion of the leaf spring member is deflected.

4. A locking mechanism for a connector, comprising:

a first electrical connector housing formed with a fitting hood;

a second electrical connector housing mated with said first connector housing and formed with a lock projection;

a leaf spring member fitted to said first electrical connector housing and formed with a lock hole engaged with said lock projection and a push spring piece brought into contact with an inner surface of said fitting hood so as to urge said lock hole against said lock projection;

wherein said first electrical connector housing accommodates a printed circuit board having two terminal end portions; and said second electrical connector housing accommodates a pair of contact terminals electrically connected to the two terminal end portions respectively and symmetrically arranged on both sides of the printed circuit board so as to be offset in a mating direction of both said electrical connector housings.

5. A locking mechanism for a connector, comprising:

a first electrical connector housing formed with a fitting hood;

a second electrical connector housing fitted to the fitting hood of said first connector housing and formed with a lock projection projecting toward the fitting hood on an outer wall surface thereof; and a leaf spring member fitted to said first connector housing and formed with a lock hole formed adjacent to one end of a base portion for engaging with the lock projection and a push spring piece for slidably engaging along an intermediate extent of an inner surface of the firing hood when the second connector housing is mated with the first connector housing, said leaf spring member extending in a mating direction between said first and second connector housings, and a contact slope portion formed adjacent to the lock hole for allowing the lock hole to be engaged with the lock projection when being brought into contact with the lock projection when the base portion is deflected against an elastic force of the base portion and the push spring piece; a return portion formed at the other end of the base portion and having a U-shape, and secured to said first connector housing; wherein the contact slope portion extends obliquely outward away from the fitting hood of said first connector housing when the base portion of the leaf spring member is deflected.

6. The locking mechanism for a connector of claim 5, wherein said first connector housing accommodates a printed circuit board having two terminal end portions; and said second connector housing accommodates a pair of contact terminals electrically connected to the two terminal end portions respectively and symmetrically arranged on both sides of the printed circuit board so as to be offset in a mating direction of both said connector housings.

7. A locking mechanism for a connector, comprising:

a female connector housing formed with a fitting hood;

a male connector housing mated with said female connector housing and formed with a lock projection; and a leaf spring member fitted to said female connector housing and formed with a lock hole for engaging with the lock projection and a cantilevered push spring piece brought into contact with an inner surface of the fitting hood so as to urge the lock hole against the lock projection, including a biasing portion for slidably engaging the push spring piece along an intermediate extent of an inner surface of the fitting hood when the male connector housing is mated with the female connector housing.

8. A locking mechanism according to claim 7, wherein said leaf spring member is formed with a base portion extending in a mating direction between said male connector housing and said female connector housing; a return portion formed at one end of the base portion and secured to said female connector housing; and a contact slope portion formed at the other end of the base portion for engaging the lock hole with the lock projection, when the base portion is deflected against an elastic force of the base portion and the push spring piece.

* * * * *

UNITED STATES PATENT AND TRADEMARK OFFICE

CERTIFICATE OF CORRECTION

PATENT NO. : 5,494,452

DATED : February 27, 1996

INVENTOR(S) : Matsumoto et al.

It is certified that error appears in the above-indentified patent and that said Letters Patent is hereby corrected as shown below:

Claim 2, col. 4, line 32, "a" should read "the electrical".

At the following locations, "a" should read "an electrical":

Claim 4, col. 4, line 49

Claim 5, col. 5, line 1

Claim 7, col. 6, line 5

At the following locations, "connector" should read "electrical connector":

Claim 5, col. 5, lines 5, 8, 13, 14, 16, 23, and 25

Claim 6, col. 6, line 4

Claim 8, col. 6, lines 22, 23, and 25

UNITED STATES PATENT AND TRADEMARK OFFICE

CERTIFICATE OF CORRECTION

PATENT NO. : 5,494,452

DATED : February 27, 1996

INVENTOR(S) : Matsumoto et al.

It is certified that error appears in the above-indentified patent and that said Letters Patent is hereby corrected as shown below:

Claim 7, col. 6, lines 15-19 "including a biasing... connector housing." should read "said push spring piece slidably engaging along an intermediate extent of an inner surface of the fitting hood when the male electrical connector housing is mated with the female electrical connector housing."

Signed and Sealed this

Twenty-seventh Day of August, 1996

*Attest:*

Bruce Lehman

BRUCE LEHMAN

*Attesting Officer*

*Commissioner of Patents and Trademarks*